United States Patent [19]

Klein

[11] Patent Number: 4,809,469

[45] Date of Patent: Mar. 7, 1989

[54] ASSEMBLY OF CLIP AND DOOR FRAME MEMBERS

[76] Inventor: Mathew M. Klein, 27908 Longhill Dr., Rancho Palos Verdes, Calif. 90274

[21] Appl. No.: 29,777

[22] Filed: Mar. 25, 1987

[51] Int. Cl.[4] ..... E06B 1/00

[52] U.S. Cl. ..... 52/32; 52/212; 52/213

[58] Field of Search ..... 52/32, 212, 213, 214, 52/211, 656, 658, 716; 49/401, 404, 505

[56] References Cited

U.S. PATENT DOCUMENTS

| | | | |
|---|---|---|---|
| 2,902,727 | 9/1959 | Samolis | 52/212 |
| 3,927,492 | 12/1975 | Carson | 52/212 |
| 4,570,399 | 2/1986 | Wentink | 52/213 X |

*Primary Examiner*—J. Karl Bell

*Attorney, Agent, or Firm*—Frank L. Zugelter

[57] ABSTRACT

A frame-and-clip assembly utilized in the installation of a door frame to a compartment used for storage, baggage or the like, such as found in a recreational vehicle or other shell-like camper housing, although adaptable to compartments in other housings as well. The frame member includes first and second legs extending in opposite directions but joined by a spacer member between them, and a notch located in the corner region of the first leg and the spacer member. The second leg is adapted to engage the outer wall surface of a wall section forming the exterior boundary of the compartment. The clip gripping member comprises generally an upright member mounted on a base and extending over the length of the first leg, a barb on the base for attaching to the notch and a flange and lip for wrapping around the distal end of the first leg. A thinner cross-section in the base, adjacent the gripping member, facilitates the assembly. Either a hook or an extension is integrally formed with the base for either frictionally engaging an interior wall surface or physically attaching such as by stapling to a different wall section forming the compartment, respectively. The frame member is fabricated from a rigid material, such as an aluminum extrusion, while the clip is fabricated from rigid yet flexible material such as vinyl plastic. Means are provided in the first leg of the frame member to mount a weather seal ribbon and to utilize a screw for retaining mitered sections of the frame member together in another alternative embodiment of the invention.

46 Claims, 2 Drawing Sheets

60
61
62
30
25
17
19
18
11
59
65-2
39
67
65-1
22
37
15
64
63
52
46
47
38
16
56
65
66
9
7

ASSEMBLY OF CLIP AND DOOR FRAME MEMBERS

TECHNICAL FIELD

This invention relates to door frame assemblies and in particular, to such an assembly and its installation to compartments, examples of which being storage and baggage compartments.

PRIOR ART

Constructions of frame assemblies for compartments and windows are disclosed in the following U.S. Pat. Nos. 2,902,727; 3,403,476; 3,420,003; 3,728,833; 4,280,309; and 4,407,100.

PROBLEMS IN THE PRIOR ART

Installation of frames for doors operatively connected to compartments, examples being the storage and baggage kind, particularly in their production for recreational vehicles and camper shells, and the like, is time-consuming and arduous in labor because of the limited manner or way by which the assembly worker is caused to manually work to permanently mount a door frame to an opening in a side wall of the housing for a recreational vehicle, camper shell, or the like.

SUMMARY OF THE INVENTION

The subject matter of the invention is an assembly of a clip member with a frame of a door, such assembly making of ease the installation of the door frame to or about a compartment formed by wall sections. This assembly comprises a clip member which is formed from a one-piece rigid flexable material, such as vinyl plastic, it having a base adapted for parallel disposition to a wall section of the compartment, a gripping member which extends from the base in a direction into the opening of the compartment, such gripping member including a flange and a lip mounted on a first leg of the cooperating rigid door frame member at a distal point from the base, and an attaching barb mounted on the base in generally spaced relationship to the flange and lip so as to form a channel in which such first leg is mounted or assembled. In addition to this first leg, the frame member includes a second leg joined to the first leg by a spacer member adapted for parallel disposition to the wall section forming the compartment, both legs being generally parallel to one another but extending in opposite directions from such spacer member. The second leg is adapted to grip the exterior wall surface for the compartment, while an extension to or a hooking element mounted on the base of the clip is provided to secure the clip member to an interior wall surface on the wall section of the compartment. Two channels are provided in the first leg itself of the frame member, one (a volumetric corridor) to receive a ribbon of weather sealing material which mates with a closed door, the other being circular in configuration to secure the frame members in an alternative embodiment of the invention.

The base member includes, in more particularity, an integral extension that is stapled to a surface of a wall section of the compartment, or includes a hook member integrally formed at an acute angle with the base so as to frictionally grip a wall surface of the wall section forming the compartment.

An object of this invention is to provide a novel clip and frame assembly for compartments or the like.

Another object of this invention is to facillitate installation of a door frame to its compartment or the like.

A still further object of the invention is to reduce labor and degree and manner of labor in the installation of a door frame to its compartment walls.

Another object of the invention is to provide interchangeability of clip members in the installation of a door frame to walls forming a compartment.

These and other objects and advantages of the invention will become more apparent on a full and complete reading of the following description, the drawing comprising two sheets of figures, and the appended claims.

PREFERRED MODE OF CARRYING OUT THE INVENTION

Figure 1:
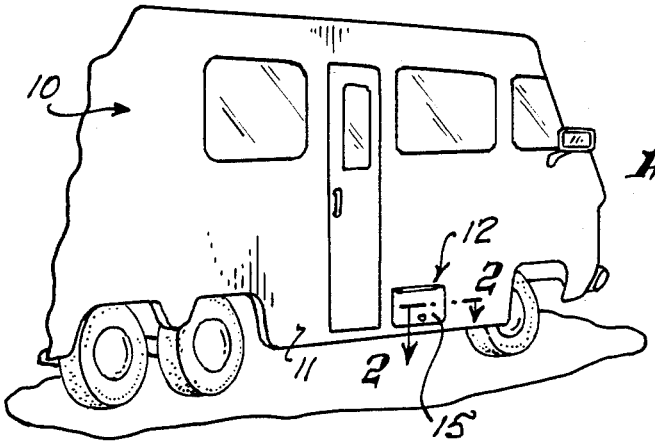
FIG. 1 is a perspective view of a motorhome on which the invention is adaptable for use.
Figure 2:
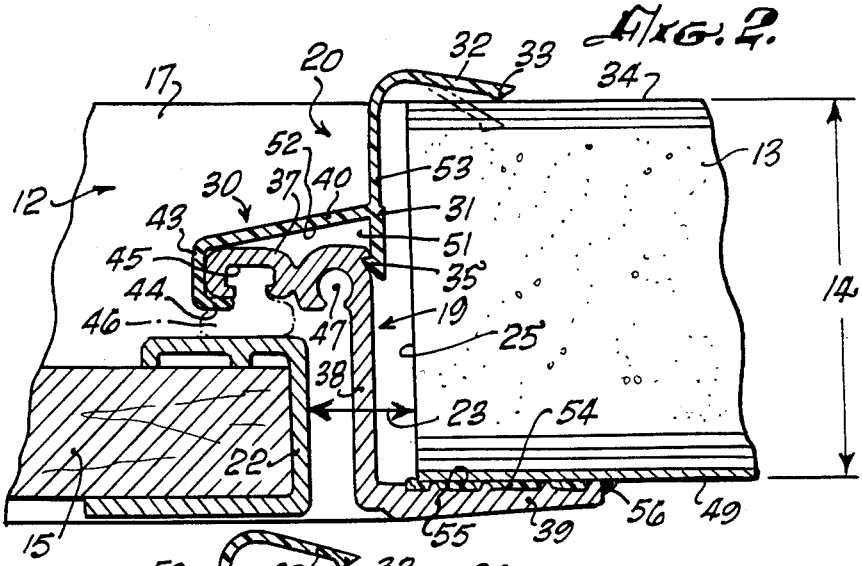
FIG. 2 is a view taken on line 2—2 of FIG. 1.

Referring now to the drawing wherein reference characters correspond to like numerals hereinafter, FIG. 1 illustrates the adaptation of the invention to a motor home 10 which, along with recreational vehicles and camper shells, the invention has been found to be of greatest value to date. Motor home 10 is of a typical or conventional kind, including a side wall 11 in which a compartment 12 is located, being utilized generally for storage, baggage, or the like. Compartment 12 includes one of two kinds of wall sections, each readily adaptable for installation of the embodiments described herein. FIG. 2 illustrates one kind of wall section 13, having a finite thickness 14, the wall section itself extending generally in a direction parallel to the plane of a door 15, FIGS. 1, 2, which keeps compartment 12 closed. It also may be of the kind 16 illustrated in FIGS. 7, extending generally in a direction at a right angle to the plane of door 15, or in a general direction determining depth of the compartment. It becomes apparent that these kinds of wall sections define differently formed compartments and the invention is readily adaptable to such compartment constructions, as will be shown by the hereinafter description.

Figures 5, 6, 7, 8, 9:
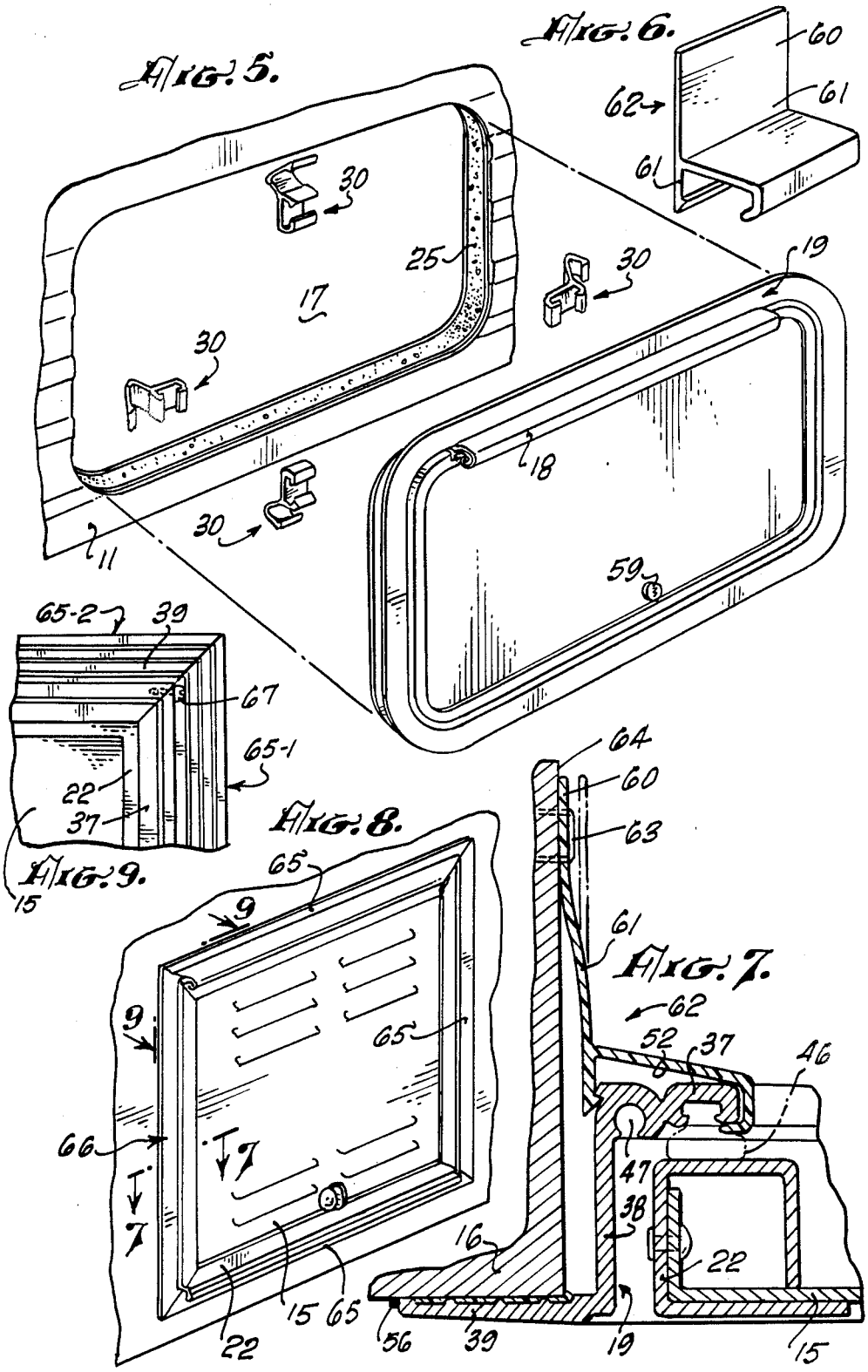
FIG. 5 is a perspective exploded view of an installation employing the invention.
FIG. 6 is a perspective view of another clip element forming a portion of another embodiment of the invention.
FIG. 7 is a view taken on line 7—7 of FIG. 8.
FIG. 8 is a fragmentary perspective view of another installation employing the invention.
FIG. 9 is a view taken on line 9—9 of FIG. 8.

In the FIG. 2 embodiment, compartment 12 comprises an opening 17 formed by an endless wall section 13 therearound, i.e., with no wall sections such as 16 (FIG. 7). Door 15 is hingedly mounted, as at 18, FIG. 5, in known manner and fashion to the frame member 19 of the frame-and-clip assembly 20, FIG. 2, of this invention, the innards (walls) forming other finite wall sections of compartment 12 not being essential to the disclosure of this embodiment. Door member 15 includes a metallic finishing strip 22, of a generally U-shaped configuration, which prefits around the edges of member 15, in known fashion and manner. A suitable spacing 23 extends between strip 22 and the thickness or edge 25 of wall section 13. It is within spacing 23 that subject matter of the present invention is installed.

Figure 3:
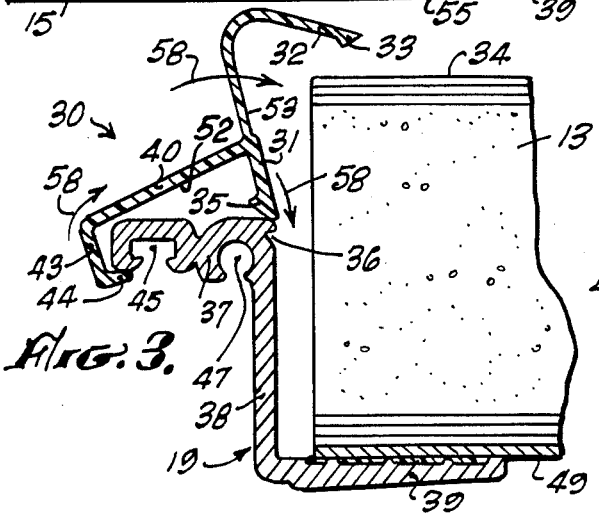
FIG. 3 is a view similar to FIG. 2, however, showing a manner of snapping together elements of the invention in its assembly to a wall section.
Figure 4:
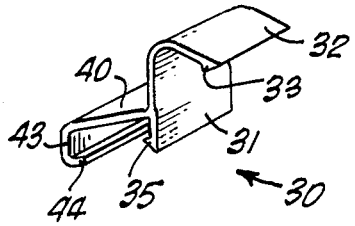
FIG. 4 is a perspective view of a clip element forming a portion of an embodiment of the invention.

The frame and clip assembly 20 comprises the frame member 19 and a clip member 30 (FIG.4). Clip member 30 includes a base 31 adapted for parallel disposition to edge 25 of wall section 13, a flexible hook or flange 32 integrally formed to and extending from base 31 at its one terminus and having thereon a terminal barb 33. Hook 32 is integrally formed at an acute angle with base 31, to frictionally grasp or engage the interior wall surface 34 of wall section 13. The other end of base 31 includes a barb 35, extending in a direction opposing that for hook 32, for introduction into a notch 36, FIG. 3, formed in the corner region of a first leg member 37 of frame 19 and a spacer member 38 joining together leg member 37 with a second leg member 39 of frame member 19. A gripping member 40 extends generally upwardly from base 31, and a flange 43 and lip 44 are integrally mounted thereon at a distal point from base 31 to embrace the outer end of leg member 37, as member 40 is wrapped around leg 37 in assembly. A channel or volumetric corridor 45 is included in leg member 37, preferably in its distal end, for installation of a rubber weather seal in the form of a ribbon 46, shown in phantom in FIG. 2. Ribbon 46 is adapted to engage finishing strip 22 as door 15 closes upon opening 17. The inwardly disposed portion of leg member 37 includes a circular channel 47 which serves the double function of material saving and of providing a bore for mounting a screw in the assembly of a second embodiment and adapted for installation to a mitered-constructed door frame, to be described hereinafter. Leg members 37, 39 generally are in parallel relationship to one another, but extend in directions opposite to one another, the second leg member 39 gripping an outside wall surface 49 of wall section 13.

Clip member 30 is formed from a rigid yet flexible material, such as plastic or vinyl, its flexible characteristic being for the purpose of easily assembling it to both the inner wall surface 34 and to the first leg 37 of frame member 19. Whereas, frame member 19 is formed of a rigid material, such as aluminum or other suitable metal. Frame member 19 is readily extruded in desired lengths of aluminum and from which desired lengths for fabrication of its endless form about opening 17 can be carried out. Likewise, the material for clip 30 is formed in desirable lengths and then cut into shortened portions constituting the width of each clip 30.

It is to be noted that upright member 40 in clip 30 is integrally formed to clip 30 at an angle from the perpendicular to base 31, as seen in FIG. 2. Such angularity provides for a spacing 51 in the channel 52 formed by gripping member 40 and base 31 and which further facilitates the ease of installation of the subject assembly to wall section 13. A thinner cross-section in base 31, as at 53, FIGS. 2, 3, along some length of base 31 from its juncture with gripping member 40 and towards hook 32, is included to also provide for ease of installation, by adding an additional flexibility in movement to base 31 and hook 32 as clip 30 is assembled as shown in FIG. 3.

It also is to be noted that in FIGS. 2, 3, notch 36 is located at the corner formed by the juncture of leg 37 and spacer 38, however, the location of notch 36 need not be restricted thereto but may be located elsewhere in the region about such corner, such as along the length of spacer 38, or along leg 37. It should be apparent that a savings in material (the vinyl plastic) is effected by location at such juncture for notch 36, as a lesser amount of length of base 31 between barb 35 and gripping member 40 is required.

In the assembly of this embodiment, referring to FIGS. 3 and 5, a plurality of clip members 30 are utilized with frame 19, with at least one clip 30 being mountable along each of the four wall sections 13 whose edges 25 form opening 17. FIG. 5 shows door 15 already hingedly mounted as at 18 to the extruded endlessly-formed frame 19, along its top horizontal portion. Beads of sealer 54, FIG. 2, such as silicon, first are applied to outer wall surface 49, either directly or by applying it to the cavities of pockets 55 optionally formed in leg 39. Door 15 is opened about its hinged mounting to frame member 19, and the subassembly of door and frame member 19 is thrust into opening 17. With door 15 opened, and for each clip 30, the installer wraps gripping member 40 around leg 37 by means of barb 35 being introduced into notch 36 with and flange 43 and lip 44 grasping the distal end of leg 37 prior to introducing barb 35 into notch 36. The movement of clip member 30 about leg 37 is shown in FIG. 3 by arrows 58, during the clip-on of clip 30 to frame member 19. Thereafter, hook 32 of each clip 30 is readily snapped onto innerwall surface 34, by flexing base 31. This step of assembly is carried out as many times as there are clips 30 to be assembled to frame member 19. Another bead of silicon 56 may be applied at the terminal end of leg 39 and on exterior surface 49. The result is the permanent assembly of door 15 and door frame 20 to its compartment 20. The unit thus is assembled to the opening 17, and the door panel 15 then is closable and lockable by means of a lock 59, which is a conventional lock that includes a tang at the end of its cylinder, rotatable to engage with the wall surface 34, thereby locking the door. The entire assembly can not be pulled out of the opening, without destroying the utility of the invention.

Another embodiment is illustrated by FIGS. 6 and 7. In this instance, an extension 60 is integrally mounted on the base 61 of a clip 62, FIG. 6 for stapling, as at 63, FIG. 7, to a wall surface 64 of a wall 16 which in its depth forms the compartment to which the invention is to be mounted. In installation assembly, the gripping member on clip 62 first is mounted to leg 37 of frame member 19. Then after clip-and-frame assembly 20 is thrust into opening 17, door 15 is opened about its hinged mounting at 18, and the extensions 60 on the bases 61 of clips 62 are stapled as at 63 to interior wall surfaces 64 of wall section 16.

In a further embodiment of the invention, FIGS. 8 and 9, each of four (4) straight frame members 65 are mitered at their ends, as distinguished from the endless frame shown in FIG. 5, and joined together as shown in FIG. 8 to form a frame assembly 66. In order to secure each of the four mitered straight frame members 65 of frame assembly 66 to its next adjacent straight frame member, a screw 67, FIG. 9, is utilized. Screw 67 is threaded through a hole [not visible in FIG. 9, but is located in FIG. 9 at the base of the head of screw 67] formed through the space member 38 immediately adjacent to the miter of one straight frame member 65-1, FIG. 9, passing the miter in the next adjacent straight frame member 65-2, to engage and be tightly thrust into the circular bore 47 of the last-mentioned frame member 65-2 itself, FIG. 9.

Clips 30 are cut from an elongated fabricated ribbon or strip of known vinyl plastic material. Frame member 18 is formed by known extrusion aluminum processes, and is cold metal worked to form its endless configuration in the embodiment illustrated in FIG. 5.

INDUSTRIAL APPLICABILITY

This invention is readily adaptable to the installation of door frames to storage, baggage, and other types of compartments that are utilized in the recreational vehicle industries. However, wherever a compartment is required to be installed, in any form of a housing, this invention is readily adaptable thereto.

Various modifications and changes can be made. Should a deeper or shallower closing of the door be desired, suitable dimensional changes can be made in the clip and/or frame member. For a thinner wall section 13, hook 32 need not be made as long as in the case of a thicker wall section. Also, in some assemblies, either volumetric corridor 45 or channel 47 (whether circular or otherwise), or both, may be omitted. And the clips 30, 62 are interchangeable between the endless and mitered frame members.

I claim:

1. A clip member formed from a one-piece rigid yet flexible material for assembly to a frame member for a door or the like, such assembly adaptable for an installation to a wall section forming an opening for a compartment or the like, said clip member comprising a base having an end and a barb attachable to the frame member mounted on said base at such end, means integrally mounted to said base and extending in a direction along said base in opposition to said barb for attaching the clip member to a surface of the wall section, and a gripping member integrally mounted generally upright from and to said base, extending in a direction into such opening from said base upon assembly to the frame member, said gripping member including a flange and lip integrally formed on a distal end from said base thereby forming a channel into which said frame member becomes disposed, said attachable barb cooperating with said flange and lip so as to effect a wrap around of the frame member.

2. The clip member of claim 1 wherein said attaching means comprises an elongated extension integrally formed to said base so as to secure through stapling said clip member to a surface of a wall section forming a wall of depthness to the compartment in which installation of the assembly is carried out.

3. The clip member of claim 1 wherein said attaching means comprises a hook integrally formed to and forming an acute angle with said base whereby upon flexing it into a more open angularity with said base it is frictionally applied to an interior wall surface of a wall section of the compartment in which installation of the assembly is carried out.

4. The clip member of claim 3 including a barb on the end of said hook for operative connection to the interior wall surface.

5. The clip member of claim 1 or claim 2 or claim 3 or claim 4 wherein said gripping member is inclined in a direction towards the position of a door adaptable for mounting in the opening.

6. A frame member for a door or the like formed from a one-piece rigid material for assembly to a clip member, such assembly adaptable for an installation to a wall section forming an opening for a compartment or the like, said frame member comprising a first leg, a second leg, a space member joining together the first leg and the second leg, the first leg extending from said spacer member in a direction opposite to the direction said second leg extends from said spacer member, said second leg in its direction of extension adapted to engage an outer wall surface of the wall section, and means mounted on said first leg by which the clip member wraps around and grips said first leg of said frame member in their assembly.

7. The frame member of claim 6 wherein said mounted means on said first leg comprises a notch mounted in the corner region of said first leg and spacer member, the first leg having a distal end, the clip member adapted to clip onto said notch and to wrap around said distal end.

8. The frame member of claim 6 or claim 7 including means in said first leg for mounting a weather-sealing ribbon of material adapted to engage a door for the compartment.

9. The frame member of claim 8 wherein said mounting means comprises a volumetric corridor formed in said leg.

10. The frame member of claim 9 including a channel formed in and along said first leg between said mounting means and said spacer member.

11. The frame member of claim 8 including a channel formed in and along said first leg between said mounting means and spacer member.

12. The frame member of claim 6 or claim 7 including a channel formed in and along said first leg.

13. The frame member of claim 6 or claim 7 wherein said first leg and second leg are parallel to one another.

14. The frame of claim 8 wherein said first leg and second leg are parallel to one another.

15. The frame member of claim 9 wherein said first leg and second leg are parallel to one another.

16. The frame member of claim 10 wherein said first leg and second leg are parallel to one another.

17. The frame member of claim 13 wherein said first leg and second leg are perpendicular to said spacer member.

18. The frame member of claim 8 wherein said first leg and second leg are perpendicular to said spacer member.

19. The fame member of claim 9 wherein said first leg and second leg are perpendicular to said spacer member.

20. The frame member of claim 10 wherein said first leg and second leg are perpendicular to said spacer member.

21. The frame member of claim 11 wherein said first leg and second leg are perpendicular to said spacer member.

22. The frame member of claim 12 wherein said first leg and second leg are perpendicular to said spacer member.

23. The frame member of claim 14 wherein said first leg and second leg are perpendicular to said spacer member.

24. The frame member of claim 15 wherein said first leg and second leg are perpendicular to said spacer member.

25. The frame member of claim 16 wherein said first leg and second leg are perpendicular to said spacer member.

26. The frame member of claim 12 wherein said first leg and second leg are parallel to one another.

27. An assembly of frame and clip members each of which being formed from a one-piece material, the frame member of a rigid material, the clip member of a rigid yet flexible material, the assembly adapted for installation upon a wall section forming an opening for a compartment or the like and comprising first and second legs in the frame of said members and extending in opposing directions to one another and joined together by a spacer member adapted to be disposed generally in parallel relation to the wall section, the second of said legs adapted to engage an outside wall surface of the wall section, a notch in said frame member mounted in the corner region of the first of said legs and spacer member, a base in the clip of said members and including a barb attached to said notch, a gripping member on the clip having a flange and lip mounted at a distal end from said base thereby forming a channel, said barb and base, and notch, flange, lip and gripping member wrapping around said first leg as it is disposed in said channel, and means integrally mounted to said base for attaching the assembly to the wall section.

28. The assembly of claim 27 wherein said gripping member is inclined in a direction towards the position of a door adaptable for mounting in the opening.

29. The assembly of claim 27 or claim 28 wherein said attaching means comprises a hook integrally formed to and forming an acute angle with said base whereby upon flexing it into a more open angularity with said base it is frictionally applied to an interior wall surface of the walls section of the compartment in which installation of the assembly is carried out.

30. The assembly of claim 27 or claim 28 wherein said attaching means comprises an elongated extension integrally formed to said base so as to secure through stapling said clip to a surface of the wall section forming a wall of depthness to the compartment in which installation of the assembly is carried out.

31. The assembly of claim 29 including means in said first leg for mounting a weather-sealing ribbon of material adapted to engage a door for the compartment.

32. The assembly of claim 30 including means in said first leg for mounting a weather-sealing ribbon of material adapted to engage a door for the compartment.

33. The assembly of claim 31 including a channel formed in and along the first of said legs between said mounting means and spacer member.

34. The assembly of claim 32 including a channel formed in and along the first of said legs between said mounting means and spacer member.

35. The assembly of claim 27 or claim 28 including a channel formed in the first of said legs.

36. A compartment comprising a body formation including a wall section formed about an opening, an assembly of frame and clip members each formed from one-piece materials, the frame member being of a rigid material, the clip member being of a rigid yet flexible material, the assembly adapted for installation upon the wall section and comprising first and second legs and a spacer member in the frame of said members, said legs extending in opposing directions to one another and joined together by said spacer member which is adapted to be disposed generally in parallel relation to the wall section, the second of said legs adapted to engage an outside wall surface of the wall section, a notch in said frame member mounted in a corner region of the first of said legs and spacer member, a base in the clip of said members and including a barb attached to said notch, a gripping member on the clip having a flange and lip mounted at a distal end from said base thereby forming a channel, said barb and base, and notch, flange, lip and gripping member wrapping around said first leg as it is disposed in said channel, and means integrally mounted to said base for attaching the assembly to the wall section.

37. The compartment of claim 36 wherein said gripping member is inclined in a direction towards the position of a door adaptable for mounting in the opening.

38. The compartment of claim 38 or claim 37 wherein said attaching means comprises a hook integrally formed to and forming an acute angle with said base whereby upon flexing it into a more open angularity with said base it is frictionally applied to an interior wall surface of the wall section of the compartment in which installation of the assembly is carried out.

39. The compartment of claim 36 or claim 37 wherein said attaching means comprises an elongated extension integrally formed to said base so as to secure through stapling said clip to a surface of the wall section forming a wall of depthness to the compartment in which installation of the assembly is carried out.

40. The compartment of claim 36 or claim 37 including a volumetric corridor formed in and along the first of said legs.

41. The compartment of claim 36 or claim 37 including a circular channel formed in and along the first of said legs.

42. The compartment of claim 40 including a circular channel formed in and along the first of said legs between said volumetric corridor and spacer member.

43. The compartment of claim 38 including a volumetric corridor formed in and along the first of said legs.

44. The compartment of claim 43 including a circular channel in the first of said legs between said volumetric corridor and spacer member.

45. The compartment of claim 35 including a volumetric corridor in and along the first of said legs.

46. The compartment of claim 45 including a circular channel in the first of said legs between said volumetric corridor and spacer member.

* * * * *

UNITED STATES PATENT AND TRADEMARK OFFICE

CERTIFICATE OF CORRECTION

PATENT NO. : 4,809,469

DATED : March 7, 1989

INVENTOR(S) : Mathew M. Klein

It is certified that error appears in the above-identified patent and that said Letters Patent is hereby corrected as shown below:

In column 8, line 29, "38" is to be read as -- 36 --.

In column 8, line 62, "35" is to be read as -- 39 --.

Signed and Sealed this

Twenty-second Day of August, 1989

*Attest:*

*Attesting Officer*

DONALD J. QUIGG

*Commissioner of Patents and Trademarks*